US010756501B2

(12) United States Patent
Chen et al.

(10) Patent No.: US 10,756,501 B2
(45) Date of Patent: Aug. 25, 2020

(54) SYSTEM AND METHODS FOR HEATING A FORMING DIE

(71) Applicant: The Boeing Company, Chicago, IL (US)

(72) Inventors: Cameron Kai-Ming Chen, Seattle, WA (US); Marc R. Matsen, Seattle, WA (US); Robert James Miller, Fall City, WA (US); Scott David Billings, Des Moines, WA (US)

(73) Assignee: The Boeing Company, Chicago, IL (US)

( * ) Notice: Subject to any disclaimer, the term of this patent is extended or adjusted under 35 U.S.C. 154(b) by 405 days.

(21) Appl. No.: 14/720,045

(22) Filed: May 22, 2015

(65) Prior Publication Data

US 2016/0344152 A1 Nov. 24, 2016

(51) Int. Cl.

| | |
|---|---|
| ***H01R 43/16*** | (2006.01) |
| ***H05B 6/36*** | (2006.01) |
| ***H05B 6/10*** | (2006.01) |
| ***H05B 6/22*** | (2006.01) |
| ***H05B 6/40*** | (2006.01) |
| *H01F 41/04* | (2006.01) |

(52) U.S. Cl.

CPC ..... *H01R 43/16* (2013.01); *H05B 6/10* (2013.01); *H05B 6/105* (2013.01); *H05B 6/22* (2013.01); *H05B 6/36* (2013.01); *H05B 6/365* (2013.01); *H05B 6/40* (2013.01); *H01F 41/046* (2013.01); *Y10T 29/49075* (2015.01); *Y10T 29/49078* (2015.01)

(58) Field of Classification Search

CPC ..... H01R 43/16; H05B 6/10; H05B 6/105; H05B 6/36; H05B 6/365; H05B 6/22; Y10T 29/49075; Y10T 29/49078; H06B 6/40; H01F 41/046

See application file for complete search history.

(56) References Cited

U.S. PATENT DOCUMENTS

| | | | | |
|---|---|---|---|---|
| 2,749,423 | A * | 6/1956 | Bisterfeld | H05B 6/365 219/633 |
| 3,602,625 | A * | 8/1971 | Duca | H05B 6/22 373/142 |
| 4,082,936 | A | 4/1978 | Aoki et al. | |
| 5,338,497 | A | 8/1994 | Murray et al. | |
| 5,844,213 | A * | 12/1998 | Peysakhovich | H05B 6/365 219/647 |
| 6,091,063 | A * | 7/2000 | Woods | H05B 6/365 219/633 |
| 6,730,893 | B1 | 5/2004 | Runde | |

(Continued)

FOREIGN PATENT DOCUMENTS

JP 2009140804 A * 6/2009

OTHER PUBLICATIONS

TDK Corporation, Flexible Composite-Type Electromagnetic Shield Materials for 13.56MHz RFID System Flexield Series, circa before Mar. 2, 2015, 19 pages.

*Primary Examiner* — A. Dexter Tugbang
(74) *Attorney, Agent, or Firm* — Kolisch Hartwell, P.C.

(57) ABSTRACT

Methods and systems for heating forming dies by an induction coil, including a pair of electromagnetic (EM) field stabilizers, each EM field stabilizer configured to be adjacent one end of the forming die while the forming die is within the induction heating coil.

20 Claims, 4 Drawing Sheets

(56) References Cited

U.S. PATENT DOCUMENTS

| | | | | |
|---|---|---|---|---|
| 2007/0246459 | A1* | 10/2007 | Loveless ..... | H05B 6/365<br>219/643 |
| 2010/0072192 | A1* | 3/2010 | Hirota ..... | H05B 6/365<br>219/647 |

* cited by examiner

SYSTEM AND METHODS FOR HEATING A FORMING DIE

FIELD

This disclosure relates to systems and methods of induction heating. More specifically, the disclosure relates to systems and methods for the uniform induction heating of tooling for metal forming.

INTRODUCTION

The phrase "metal working" refers to a broad collection of techniques and tooling for shaping metals in order to create a desired part, component, or structure. Metal working may include the broad categories of forming, cutting, and joining. Metal forming, in particular, involves the modification of a metal workpiece by deforming the object using mechanical forces.

Press forming is a metal forming technique that involves the application of continuous pressure or force to a workpiece as it is held within a die. In some instances, the workpiece may be heated, in order to thermally soften the metal. This thermal softening may reduce cracking in the workpiece when force is applied by the die. The workpiece may be heated by making contact with a preheated die. Use of a heated die may allow the workpiece to be formed into the desired shape while minimizing structural anomalies in the workpiece.

Many press forming tools may not be well-suited for heating in a conventional oven, due to their size and/or shape. In addition, as the size of the requisite tooling increases, the time required to preheat the tooling also increases, thereby increasing production costs, particularly where the tooling may be repeatedly reheated.

SUMMARY

The present disclosure provides methods and systems for induction heating, and for metal working using induction heating.

In some embodiments, the disclosed system may include a system for heating a forming die. The system may include an induction coil configured to surround the forming die, and to heat the forming die by generating an electromagnetic field within the forming die, and a pair of electromagnetic (EM) field stabilizers, each configured to be disposed adjacent to an end of the forming die while the forming die is within the induction coil. The pair of EM field stabilizers may be further configured to create a substantially uniform magnetic field within the forming die as the forming die is heated by the induction coil.

In some embodiments, the disclosed system may include a joggle die assembly that includes an elongate conductive joggle die having a long axis, and an EM field stabilizer disposed adjacent to each end of the elongate joggle die, where each field stabilizer includes a plurality of magnetic stabilizer plates. Each field stabilizer may be disposed so that the planes of the stabilizer plates are oriented with respect to the long axis of the elongate conductive joggle die.

In some embodiments, the disclosed method includes a method of induction heating. where the method may include placing a conductor within an induction coil, placing an EM field stabilizer adjacent each of the opposing ends of the conductor, and applying current to the induction coil to heat the conductor, where the EM field stabilizers are configured to create a substantially uniform magnetic field within the conductor as the conductor is heated by the induction coil.

In some embodiments, the disclosed method includes a method of forming a joggle bend in a stringer, where the method may include placing an elongate conductive joggle die within an induction coil, placing a field stabilizer adjacent to each end of the elongate conductive joggle die, applying current to the induction heating coil so as to induce substantially uniform heating in the elongate conductive joggle die for a time sufficient to heat the elongate conductive joggle die to at least a first predetermined temperature, placing the heated elongate conductive joggle die in a joggle press, placing the structure in the heated elongate conductive joggle die, and forming the joggle bend in the structure by compressing the heated elongate conductive joggle die in the joggle press.

The features, functions, and advantages may be achieved independently in various embodiments of the present disclosure, or may be combined in yet other embodiments, further details of which can be seen with reference to the following description and drawings.

DESCRIPTION

Overview

Figure 1:
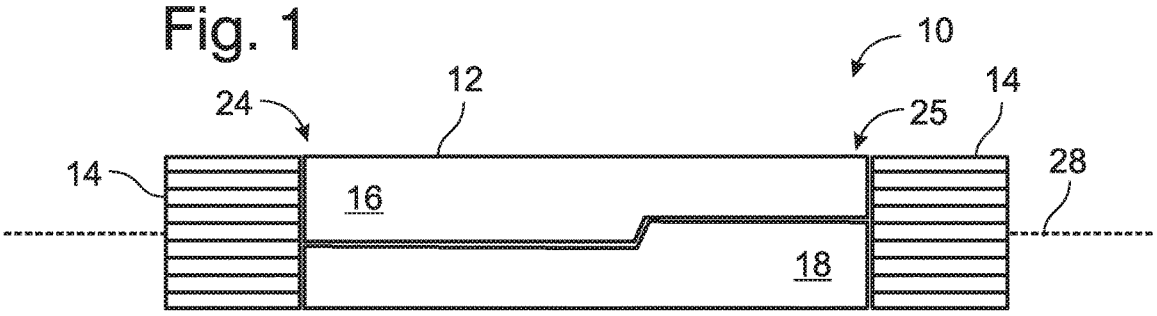
FIG. 1 is a diagrammatic and illustrative representation of a forming die abutted by a pair of electromagnetic (EM) field stabilizers.

Various embodiments of systems and methods for heating a forming die are described below and illustrated in the associated drawings, including joggle die assemblies, methods of induction heating, and methods of forming a joggle bend in a stringer.

Unless otherwise specified, the disclosed systems and methods, and/or their various components and steps may, but are not required to, contain or employ at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other metal forming tooling. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

In some applications of press forging, it may be desirable to heat the metal tooling prior to using the tooling to form a workpiece into a desired shape using a metal die and press. Alternatively or in addition, the workpiece itself may be heated to a predetermined temperature before forming. In some cases, however, the size of the workpiece or its associated tooling may prevent one or both from fitting within a conventional heating oven.

For example, a stringer is a longitudinal internal component of a structure that adds stiffness to the structure. Stringers are typically elongated thin strips of material to which the hull of a ship or skin of an aircraft may be fastened, typically running along the longitudinal direction of the craft.

Stringers may deviate from strict linearity in order to accommodate the shape of the hull, and/or to route around an internal component, such as a fuel line. A stringer may therefore incorporate one or more joggles—a preformed offset bend—in order to fit more precisely. A joggle may typically include two opposing bends, each less than 90°. Joggles may be formed in stringers using a using a joggle die that incorporates the contour of the desired joggle to be applied to the stringer. Further, structures other than stringers may also include a joggle.

Creating a joggle bend in an elongated structure, such as a stringer, may sometimes cause anomalies in the structure where the metal of the structure, for example aluminum, has not been heated sufficiently. Alternatively, localized cooling while in the tooling may compromise the ability of the tooling to shape the workpiece as desired. Such variations in temperature may be minimized by preheating the tooling, but such heating may be time consuming. For example, a 240 pound (109 kg) 30 inch (0.8 m) long steel joggle die may be heated in an oven for 2.5 hours in order to reach a desired temperature of 330° F. (166° C.), an interval that may be impractical and/or uneconomical. In addition, the tooling for some structures may be dimensioned so that they cannot fit into a conventional heating oven.

An induction heating coil may be used to preheat the tooling, provided the tooling is electrically conductive. An induction heater may include an solenoid, or wire coil, and a source of a high-frequency alternating current to be passed through the solenoid. The resulting rapidly-alternating magnetic field penetrates the object to be heated, and generates eddy currents. The inherent electrical resistance of the tooling results in resistive heating.

Due to the decrease in electromagnetic field strength from the center of an inductive heating coil to its ends, a reduced magnetization may occur at the ends of the tooling. As a result, while the center portion of the tooling may exhibit a high temperature after induction heating, the ends of the tooling may have a lower temperature. Again, the uneven temperature of the tooling may have undesirable effects on the properties of a workpiece placed into the preheated tooling.

It would therefore be desirable to heat tooling, such as forming dies, using a system that is capable of uniformly heating the tooling along its entire length, quickly and efficiently.

The diagram of FIG. 1 depicts a forming die assembly 10 that includes a forming die 12 and a pair of electromagnetic (EM) field stabilizers 14. Forming die 12 may include two sections 16 and 18, which may be referred to as the punch (16) and die (18), or male and female, respectively. Forming die 12 may be at least somewhat electrically conductive to permit heating of the forming die 12 by magnetic induction. The forming die 12 may be composed of a metal or a metal alloy, for example a formulation of steel. Forming die 12 may be an elongate die, that is forming die 12 may have a length that is greater than either its width or height. Forming die 12 may be a joggle die, and therefore may be configured to form a joggle bend in a workpiece, particularly where the workpiece may be a stringer.

The EM field stabilizers 14 may be configured to be disposed adjacent to each end 24, 25 of the forming die 12, and may be configured so that the EM field stabilizers 14 create a substantially uniform magnetic field within the forming die 12 as the forming die 12 is undergoes inductive heating. The magnetic field with the forming die 12 may be considered to be a substantially uniform magnetic field when the strength of the magnetic field within the forming die 12 varies by less than 10% along the length of the forming die 12. In one aspect of the present disclosure, the EM field stabilizers 14 may be configured so that during inductive heating the strength of the magnetic field within the forming die 12 varies by less than 5% along the length of the forming die 12.

The EM field stabilizers 14, which may be the same or different than each other, may include a plurality of stabilizer plates 20. Each stabilizer plate 20, which may be the same or different than each other, may comprise a material that is magnetic. A magnetic material is a material that may become magnetized in the presence of an applied magnetic field, and that may retain that magnetism even in the absence of the applied magnetic field. The stabilizer plates 20 may be configured to be electrically conductive, however where the stabilizer plates 20 are less electrically conductive or non-conductive, the stabilizer plates 20 may be less prone to inductive heating.

The ability of the EM field stabilizers 14 to create a more uniform magnetic field throughout the forming die 12 may be enhanced by increasing the magnetic permeability of the EM field stabilizers. Therefore, the composition, size, shape, and orientation of the stabilizer plates 20 in the EM field stabilizer 14 may be selected so as to maximize the magnetic permeability of the resulting EM field stabilizer 14, in order to minimize the inductive heating of the EM field stabilizer 14.

Each stabilizer plate 20 may comprise at least one of a ferromagnetic material and a ferrimagnetic material. In one exemplary embodiment of the disclosure, the stabilizer plates 20 may incorporate ferrite, a ferrimagnetic iron oxide-based ceramic compound. Ferrite-containing sheets are used as electromagnetic shielding in various electronic devices, and may be obtained commercially from a variety of suppliers, such as for example TDK CORPORATION, KITAGAWA INDUSTRIES America, Inc., LAIRD, and WURTH ELECTRONICS, Inc. among others.

Ferrite sheets that may be useful as stabilizer plates 20 may include one or more layers of polymer, such as PET, to confer flexibility on the resulting sheets. The ferrite compositions may incorporate a heterogeneous crystal structure, including a plurality of discrete domains, such that generation of eddy currents in the ferrite sheets may be minimized. Where the stabilizer plates 20 incorporate such ferrite sheets, the resulting EM field stabilizers 14 may be less prone to inductive heating under electromagnetic induction than if the stabilizer plates 20 possessed a more homogeneous crystal structure and/or were more electrically conductive. It may be advantageous to employ EM field stabilizers 14 that remain cooler than their associated forming die 12 under inductive heating, so that the EM field stabilizers 14 can be employed, and reused, without the necessity of waiting for the EM field stabilizers 14 to cool.

The stabilizer plates 20 of the present disclosure may have any thickness that confers utility on the stabilizer plates 20 for use in the EM field stabilizers 14 of the present disclosure. For example, the stabilizer plates 20 may have a thickness of between about 0.01 mm and about 5 mm. More particularly, the stabilizer plates 20 may have a thickness of about 0.05 mm, 0.1 mm, 0.25 mm, 0.5 mm, 1 mm, or 2 mm. In another aspect of the disclosed EM field stabilizers 14, one or more of the stabilizer plates 20 may be electrically thin, having a thickness that is less than or equal to 0.1 of the wavelength of the electromagnetic field created by the induction heater.

The stabilizer plates 20 may be disposed within the EM field stabilizer 14 so that they are at least approximately coplanar, that is the stabilizer plates 20 may be oriented so that each stabilizer plate 20 is oriented within about 10 degrees of coplanarity with every other stabilizer plate 20 of the EM field stabilizer 14, within about 5 degrees of coplanarity, or within about 1 degree of coplanarity with every other stabilizer plate 20 of the EM field stabilizer 14.

The stabilizer plates 20 of the EM field stabilizer 14 may be configured and positioned so that when the EM field stabilizer 14 is adjacent to an end 24, 25 of the forming dye 12 each stabilizer plate 20 is oriented with respect to a long axis of the forming die 12.

The stabilizer plates 20 may additionally be disposed within the EM field stabilizer 14 so that they are at least approximately equidistantly spaced. The spacing between adjacent stabilizer plates 20 in the EM field stabilizer 14 may vary by less than 20%, vary by less than 10%, or vary by less than 5%. The appropriate number and spacing of stabilizer plates 20 for a given EM field stabilizer 14 may be determined from the strength of the electromagnetic field applied by an induction heating coil, and the length and volume of the forming die 12, among other factors. The desired number and spacing of stabilizer plates 20 may be determined theoretically or by experimentation (see Example 4). Each EM field stabilizer 14 may, for example, include from 4-20 stabilizer plates 20 arranged in a parallel and equidistantly-spaced configuration. Alternatively, each EM field stabilizer 14 may include from 8-16 stabilizer plates 20 arranged in a parallel and equidistantly-spaced configuration. An appropriate spacing between adjacent stabilizer plates 20 may be calculated by determining the number of stabilizer plates 20 required to achieve the desired degree of magnetic field stabilization, setting the desired height of the EM field stabilizer 14 to match the height of the adjacent end of the forming die 12, and distributing the stabilizer plates 20 evenly within that desired height.

Figure 2:
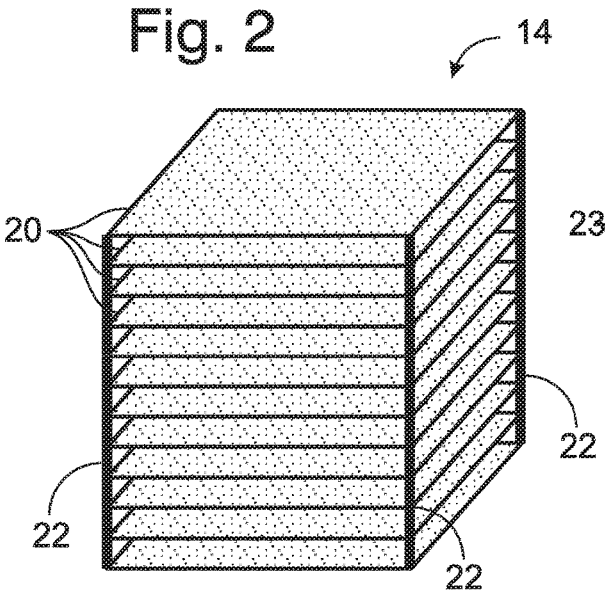
FIG. 2 is a perspective view of diagrammatic representation of an illustrative EM field stabilizer.
Figure 3:
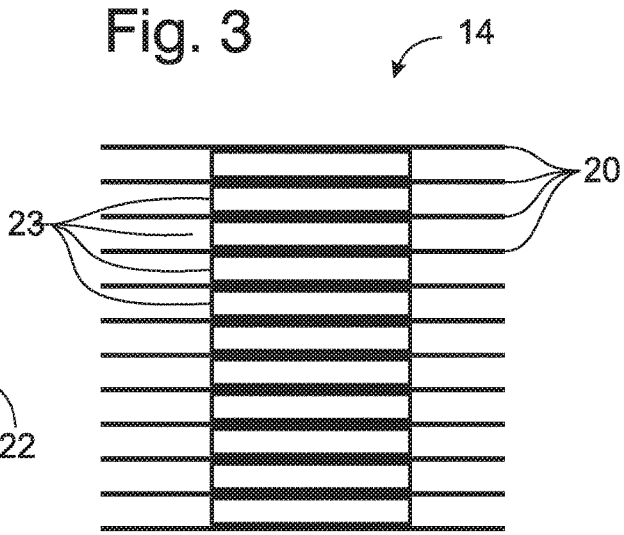
FIG. 3 is a side view of a diagrammatic representation of an illustrative EM field stabilizer.

The stabilizer plates 20 of the EM field stabilizers 14 may be separated by a non-magnetic spacer material 23, where the non-metallic spacer material 23 may include one or more of air, foam, paper, and wood, among others. As shown in FIG. 2, the stabilizer plates 20 may be retained in a desired configuration and spacing by a framework 22, in which case the non-magnetic spacer material 23 may be an air gap. Alternatively, or in addition, the stabilizer plates 20 may be separated by an alternative non-metallic spacer material 23, as shown in FIG. 3. The spacer material 23 may occupy the entire volume between adjacent stabilizer plates, or the spacer material 23 may occupy less than the entire volume between adjacent stabilizer plates 20, as shown in FIG. 3.

A pair of EM field stabilizers 14 may be placed adjacent to each end 24, 25 of the forming die 12. The EM field stabilizers 14 may be placed in contact with the forming die 12 so that no air gap exists between the EM field stabilizer 14 and the adjacent forming die 12. Alternatively the EM field stabilizers 14 may be placed so that an air gap exists between the EM field stabilizer 14 and the forming die 12, provided that the air gap is not so large as to diminish the ability of the EM field stabilizers 14 to create a substantially uniform electromagnetic field within the forming die 12 upon induction heating. In one aspect of the present disclosure, the EM field stabilizers 14 are each disposed adjacent to the ends 24, 25 of the forming die 12 with an air gap of no more than 1/16 inch (1.6 mm) between each EM field stabilizer 14 and the adjacent forming die 12.

The EM field stabilizers 14 may be configured to be generally cubic in shape, for ease of handling and placement. However, where the ends 24, 25 of the forming die are irregular in contour, the EM field stabilizers 14 may be configured to match the end contour of the adjacent end 24, 25 of the forming die 12. The stabilizer plates 20 may have an irregular outline, for example, or be offset from one another.

Figure 4:
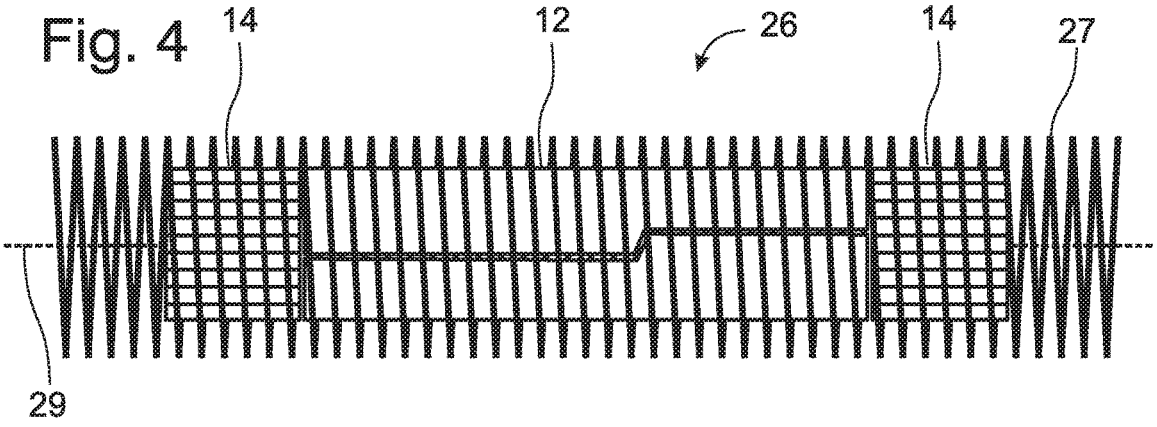
FIG. 4 is a diagrammatic and illustrative representation of a forming die abutted by a pair of EM field stabilizers disposed within an induction heating coil.

FIG. 4 depicts an exemplary system 26 for heating the forming die 12. System 26 may include an induction heating coil 27. The AC power source for the induction heating coil 27 is not shown. In order to heat forming die 12 using induction heating, the forming die assembly 10 may be disposed within the induction heating coil 27, including the forming die 12 and the EM field stabilizers 14 disposed adjacent to the ends 24, 25 of the elongate forming die 12.

The elongate forming die 12 may be placed within the induction heating coil 27 in such a way that the long axis 28 of the forming die 12 lies substantially parallel to the coil axis 29 of the induction heating coil 27. In addition to being disposed adjacent to the ends of the forming die 12, the pair of EM field stabilizers 14 may be disposed so that the planes of the plurality of stabilizer plates 20 of each EM field stabilizer 14 are parallel to the coil axis 29 of the induction heating coil 27. Without wishing to be bound by theory, by placing the EM field stabilizers 14 in this orientation, the electromagnetic field created within and through the forming die 12 by the induction heating coil 27 is made more uniform along the length of the forming die 12, in comparison with the electromagnetic field that is created in the absence of the EM field stabilizers 14 (see Example 3).

The forming die 12 may be rapidly and uniformly heated by applying an appropriate and sufficient AC current to the induction heating coil 27. More particularly, a sufficient AC current may be applied to the induction heating coil 27 for a time sufficient to heat the forming die 12 to a first predetermined temperature. The predetermined temperature may be any temperature higher than the initial temperature of the forming die 12 and lower than the melting point of the material which comprises the forming die 12. The predetermined temperature may be a temperature selected based upon the desired working temperature of a work piece 32 to be placed in the forming die 12. In one aspect of the present disclosure, the forming die 12 comprises a steel alloy, and may be heated to a substantially uniform temperature of at least 300° F. (150° C.). Alternatively, sufficient current may be applied to the induction heating coil 27 for a time sufficient to heat the forming die 12 to a substantially uniform temperature of at least 330° F. (166° C.).

A forming die is considered to be at a substantially uniform temperature when the temperature of the forming die varies by less than about +/−10° F. (+/−6° C.), and in particular when the temperature of the forming die varies by less than about +/−10° F. (+/−6° C.), along a length of the forming die.

In one aspect of the disclosure, the operating parameters of the induction heating coil 27 may be selected so as to bring the forming die to the desired temperature in no more than about 10 minutes. In particular, the operating parameters of the induction heating coil 27 may be selected so as to bring the forming die 12 to a substantially uniform temperature of at least 330° F. (166° C.) within 9 minutes or less.

Figure 5:
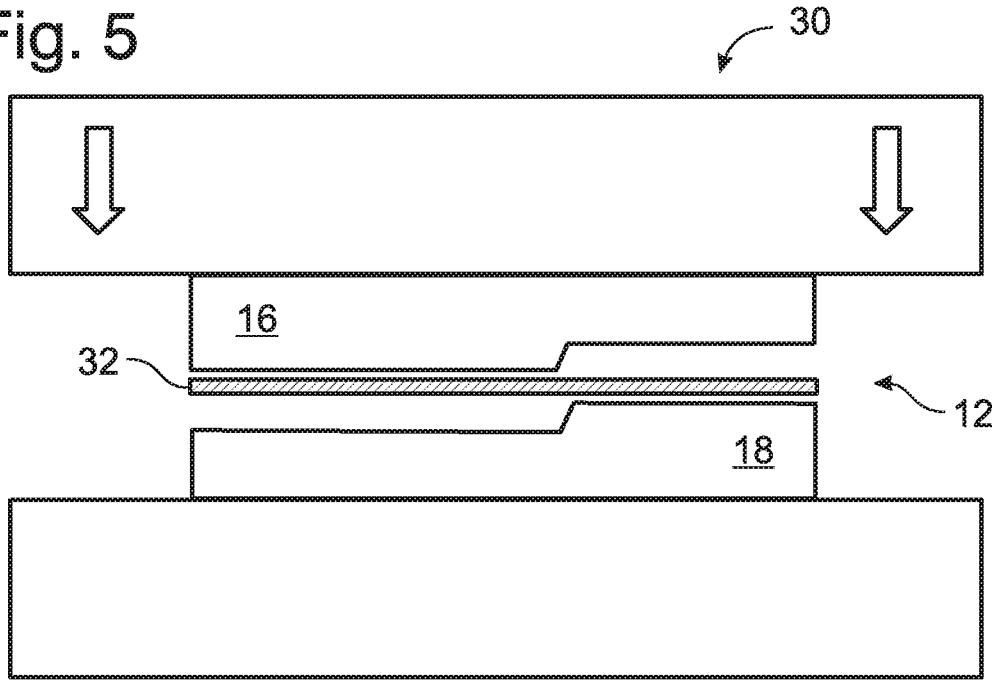
FIG. 5 is a diagrammatic representation of a stringer placed in a heated joggle die assembly, which is in turn disposed within a die press prior to forming a joggle bend in the stringer.
Figure 6:
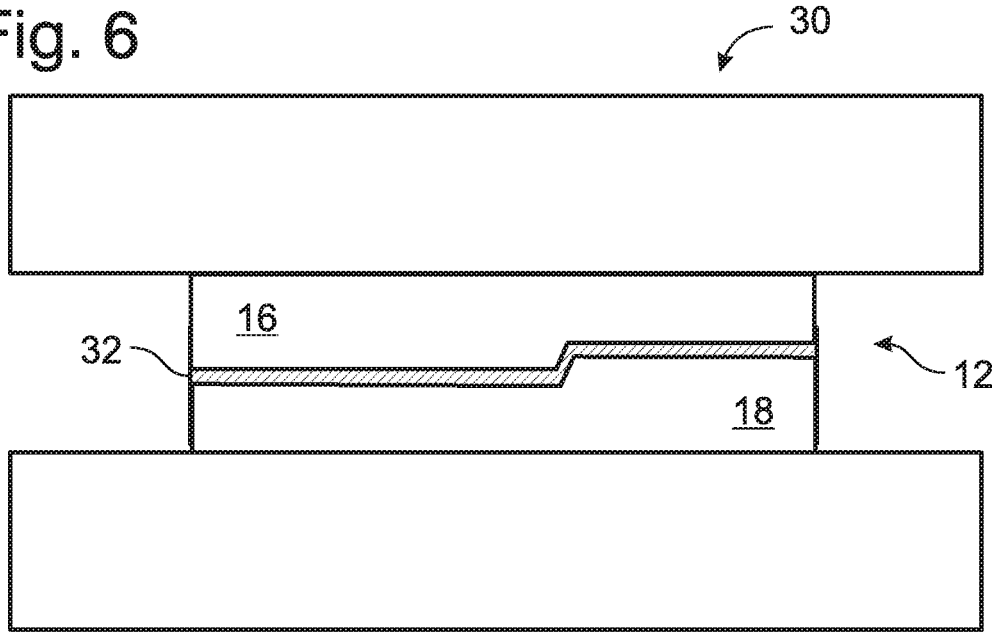
FIG. 6 is a diagrammatic representation of a stringer within a joggle die assembly disposed within a die press, after a joggle bend is formed in the stringer.
Figure 7:
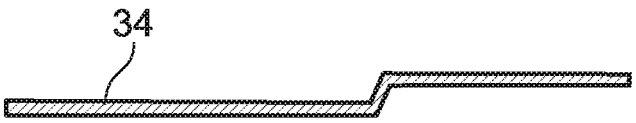
FIG. 7 is a diagrammatic representation of a stringer, after a joggle bend is formed in the stringer.

Once the forming die 12 is brought to the first desired temperature, the forming die 12 may be transferred to an appropriate press 30, as shown in FIG. 5, and the intended workpiece 32 may be placed in or on the forming die 12. The press 30 may then be activated to shape the workpiece 32 into the desired structure or conformation, as shown in FIG. 6. The product of the pressing operation 34 may then be removed from the press 30 and the forming die 12, as shown in FIG. 7.

By virtue of the structure and configuration of the EM field stabilizers disclosed herein, placing a pair of the presently disclosed EM field stabilizers at each end of a conductor within an inductive heating coil increases the magnetic field strength at the ends of the conductor, resulting in little or no reduction in the magnetic field magnitude along the length of the conductor. As a result, inductive heating may be advantageously used for preheating forming dies, and in particular joggle dies, to both rapidly and uniformly heat the dies for use in metal forming.

EXAMPLES, COMPONENTS, AND ALTERNATIVES

The following examples describe selected aspects of exemplary methods and systems for induction heating, induction heating of a forming die, and forming a joggle bend in a stringer. These examples are intended for illustration and should not be interpreted as limiting the entire scope of the present disclosure. Each example may include one or more distinct inventions, and/or contextual or related information, function, and/or structure.

Example 1

Figure 8:
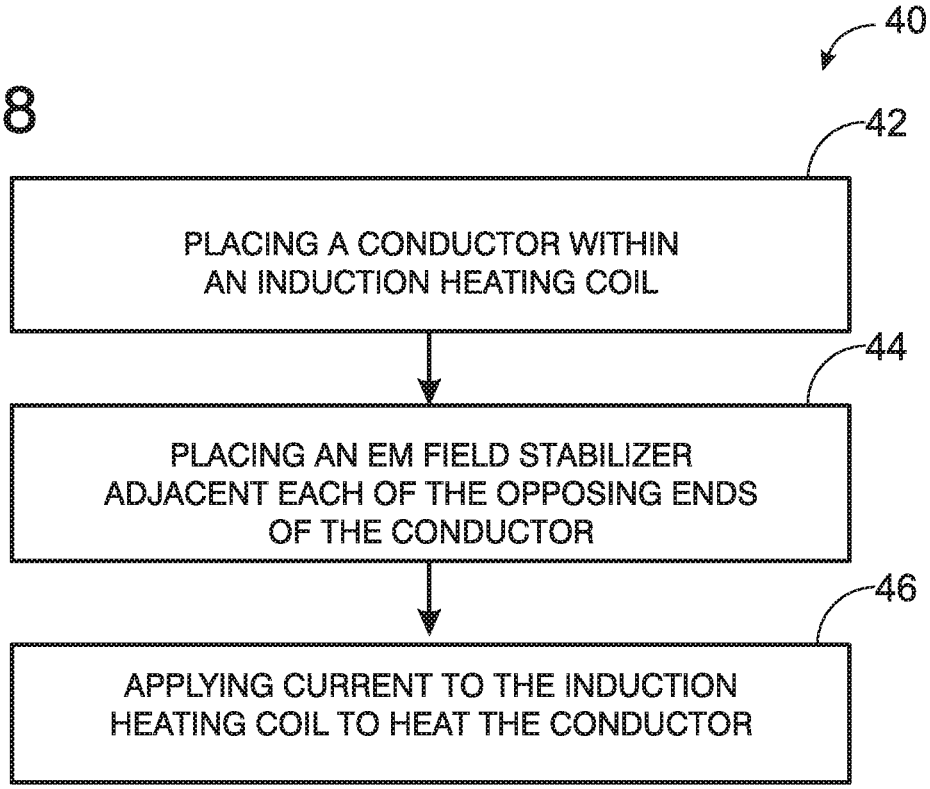
FIG. 8 is a flowchart depicting an illustrative method of induction heating.

This example describes an illustrative method of inductive heating, as set out in flowchart 40 of FIG. 8. The method of inductive heating may include the steps of placing a conductor 12 within an induction heating coil 27, at 42; placing an EM field stabilizer 14 adjacent each of the opposing ends 24, 25 of the conductor 12, at 44; and applying current to the induction heating coil 27 to heat the conductor 12, at 46.

Example 2

Figure 9:
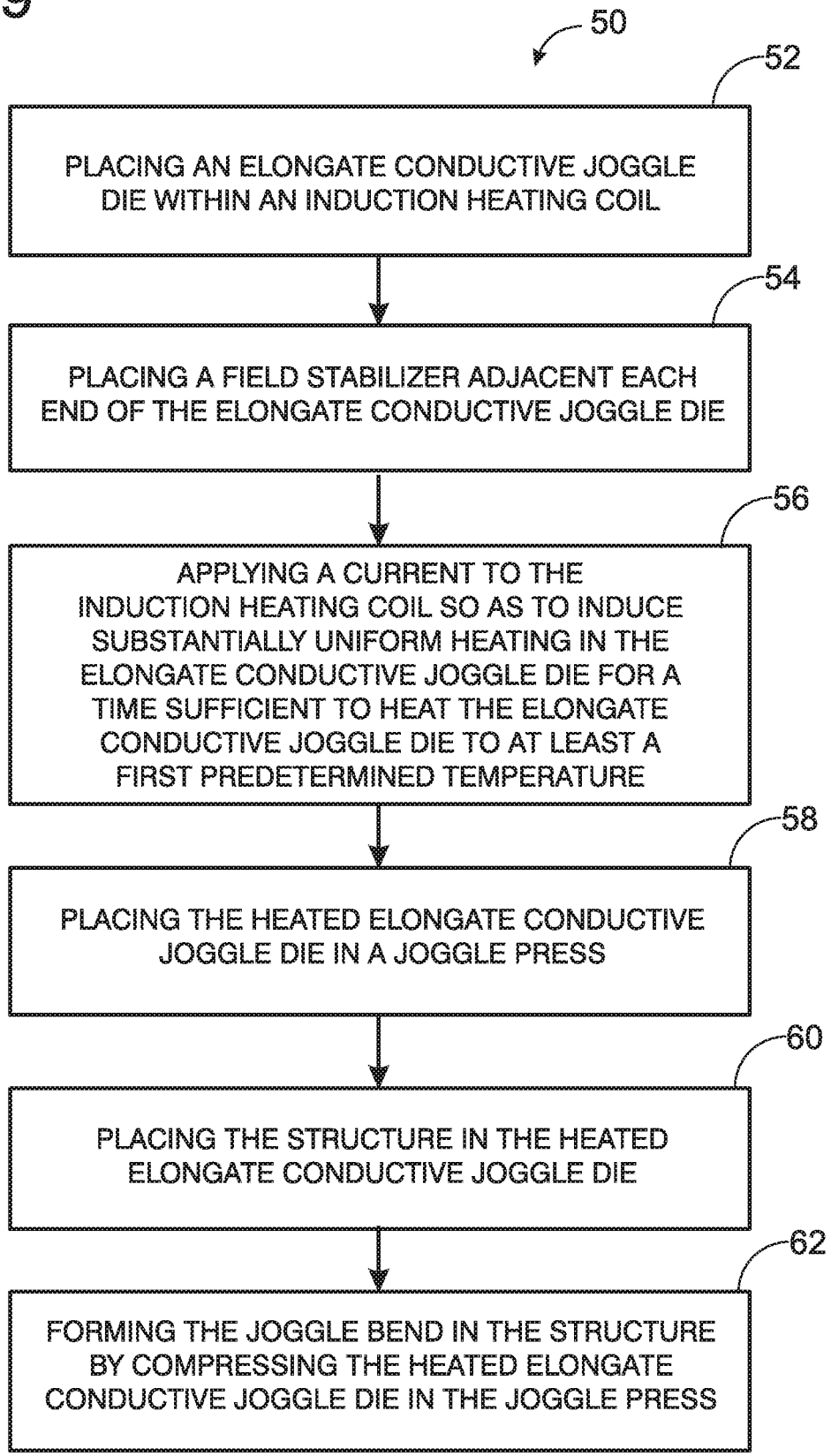
FIG. 9 is a flowchart depicting an illustrative method of forming a joggle bend in a stringer.

This example describes an illustrative method of forming a joggle bend in a structure, such as a stringer, as set out in flowchart 50 of FIG. 9. The method may include the steps of placing an elongate conductive joggle die 12 within an induction heating coil 27, at 52; placing an EM field stabilizer 14 adjacent each end 24, 25 of the elongate joggle die 12, at 54; applying current to the induction heating coil 27 so as to induce substantially uniform heating in the elongate conductive joggle die 12 for a time sufficient to heat the elongate conductive joggle die to at least a first predetermined temperature, at 56; placing the heated elongate conductive joggle die 12 in a joggle press 30, at 58; placing the structure in the heated elongate conductive joggle die 12, at 60; and forming the joggle bend in the structure by compressing the heated elongate conductive joggle die 12 in the joggle press, at 62.

Example 3

This example illustrates the effect of the EM field stabilizers 14 of the present disclosure on the magnetic field that may be generated by an induction heating coil 27.

A two-dimensional numerical simulation is constructed to model the magnetic field experienced by a steel forming die 12 placed within a 7 foot (ft) (2.1 meter) induction heating coil 27. An analysis of the calculated magnetic flux density experienced by the steel die 12 in the absence of EM field stabilizers 14 shows the magnetic field strength decreasing rapidly at the ends 24, 26 of the die 12. The field strength decrease corresponds to a decrease in eddy currents generated in the die 12, and therefore decreased resistive heating at the ends 24, 25 of the steel die 12.

When the two-dimensional numerical simulation is modified to reflect the presence of an EM field stabilizer 14 disposed adjacent each end of the steel die 12, the calculated magnetic flux density experienced by the steel die 12 is rendered substantially uniform across the die 12.

Example 4

This example illustrates the effect of the EM field stabilizers 14 of the disclosure on the uniformity of induction heating of a steel joggle die 12.

An induction heating coil 27 was prepared incorporating 70 ft (21 m) of litz wire ribbon, where the ribbon includes 15 parallel wires. The overall length of the resulting coil 27 is 7 ft (2.1 m), with a diameter of 12 in (30 cm). Heating trials are performed using a steel die 12 that is 3 ft (0.9 m) in length, and EM field stabilizers 14 comprising a variable number of 6 in×6 in (15 cm×15 cm) ferrite sheets separated by a non-metallic material.

Using the induction heating coil 27, the steel die 12 is heated until the temperature at the center of the die 12 is 330° F. (166° C.). Heating trials are conducting in the absence of EM field stabilizers 14, with a single EM field stabilizer 14 having 3, 4, or 12 sheets of ferrite, respectively, and with a pair of EM field stabilizers 14 incorporating 12 sheets of ferrite. The temperature of the steel die 12 is then measured along a length of the die.

In the absence of either EM field stabilizer 14, the steel die 12 exhibited a temperature difference of about 70° F. (21° C.) between a center of the die 12 and the ends 24, 25 of the die 12.

Employing one EM field stabilizer 14 composed of 3 equidistantly spaced ferrite sheets at one end 24 of the steel die 12, the temperature difference between the end abutting the EM field stabilizer 14 and the center of the steel die is 50° F. (10° C.), while the difference in temperature between the center and the end without the EM field stabilizer 14 is unchanged.

Employing one EM field stabilizer 14 composed of 4 equidistantly spaced ferrite sheets at one end of the steel die 12 the temperature difference between the end abutting the EM field stabilizer 14 and the center of the steel die 12 was 45° F. (7.2° C.), while the difference in temperature between the center and the end without the EM field stabilizer is unchanged.

Employing one EM field stabilizer 14 composed of 12 equidistantly spaced ferrite sheets at one end 24 of the steel die 12, the temperatures at the end 24 of the steel die 12 abutting the EM field stabilizer 14 and the center of the steel die 12 were substantially equal, while the difference in temperature between the center and the end 25 without the EM field stabilizer 14 remained unchanged.

Employing a pair of EM field stabilizers 14 each composed of 12 equidistantly spaced ferrite sheets, one disposed at each end 24, 25 of the steel die 12, the temperature of the steel die 12 is substantially uniformly across the die 12.

Heating of the steel die 12 using the induction heating coil 27 is also rapid. For example, the steel die 12 is heated to 330° F. (166° C.) in approximately 9 minutes.

Example 5

This section describes additional aspects and features of the systems and methods for induction heating of pressing dies, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A system for heating a forming die, the system comprising:

an induction coil configured to surround the forming die and heat the forming die by generating an electromagnetic field within the forming die; and a pair of electromagnetic (EM) field stabilizers, each configured to be adjacent an end of the forming die while the forming die is within the induction coil, the pair of EM field stabilizers being further configured to create a substantially uniform magnetic field within the forming die as the forming die is heated by the induction coil.

A1. The system of paragraph A0, wherein each EM field stabilizer includes a plurality of stabilizer plates separated by a non-metallic spacer material, where each stabilizer plate includes a magnetic material, and wherein each EM field stabilizer is configured so that the planes of the stabilizer plates are at least substantially parallel to a long axis of the induction coil when adjacent an end of the forming die.

A2. The system of paragraph A1, wherein the non-metallic spacer material comprises at least one of air, foam, wood, and paper.

A3. The system of paragraph A0, wherein each stabilizer plate comprises a ferrite sheet.

A4. The system of paragraph A0, wherein each EM field stabilizer comprises a number of stabilizer plates to create the substantially uniform magnetic field while the induction coil generates the electromagnetic field.

A5. The system of paragraph A4, wherein each EM field stabilizer comprises from 4-20 stabilizer plates.

A6. The system of paragraph A0, wherein each EM field stabilizer is disposed within 1/16 inch (1.6 mm) of a respective end of the forming die.

B0. A joggle die assembly comprising:

an elongate conductive joggle die having a long axis; and an EM field stabilizer adjacent each end of the elongate joggle die, wherein each field stabilizer includes a plurality of stabilizer plates, each stabilizer plate being magnetic; and each field stabilizer is disposed so that the planes of the stabilizer plates are oriented with respect to the long axis of the elongate conductive joggle die.

B1. The joggle die assembly of paragraph B0, wherein the stabilizer plates are substantially equidistantly spaced from each other and separated by a non-metallic spacer material.

B2. The joggle die assembly of paragraph B0, wherein each stabilizer plate is substantially parallel to the other stabilizer plates, and the planes of the stabilizer plates are substantially parallel to the long axis of the elongate conductive joggle die.

B3. The joggle die assembly of paragraph B0, wherein the elongate joggle die comprises a steel alloy, and is configured to be used in combination with a joggle press to form a joggle in a structure.

B4. The joggle die assembly of paragraph B3, wherein the elongate joggle die is configured to form a joggle in a stringer for use in the manufacture of an aircraft.

C0. A method of induction heating, the method comprising:

placing a conductor within an induction coil;

placing an EM field stabilizer adjacent each of the opposing ends of the conductor; and applying current to the induction coil to heat the conductor; wherein the EM field stabilizers create a substantially uniform magnetic field within the conductor as the conductor is heated by the induction coil.

C1. The method of paragraph C0, wherein placing the conductor within the induction coil comprises placing a forming die that is the conductor within the induction coil.

C2. The method of paragraph C0, wherein placing an EM field stabilizer includes placing a plurality of stabilizer plates adjacent each end of the conductor such that planes of the stabilizer plates are oriented with respect to the long axis of the conductor, and wherein each stabilizer plate is magnetic.

D0. A method of forming a joggle bend in a structure, the method comprising:

placing an elongate conductive joggle die within an induction coil;

placing a field stabilizer adjacent each end of the elongate conductive joggle die;

applying current to the induction heating coil so as to induce substantially uniform heating in the elongate conductive joggle die for a time sufficient to heat the elongate conductive joggle die to at least a first predetermined temperature;

placing the heated elongate conductive joggle die in a joggle press;

placing the structure in the heated elongate conductive joggle die; and forming the joggle bend in the structure by compressing the heated elongate conductive joggle die in the joggle press.

D1. The method of paragraph D0, wherein placing a field stabilizer adjacent each end of the elongate conductive joggle die includes placing a field stabilizer having a plurality of stabilizer plates separated by a non-metallic spacer material, each stabilizer plate being substantially magnetic, each field stabilizer being disposed so that the planes of the stabilizer plates are approximately parallel to the long axis of the induction coil.

D2. The method of paragraph D0, wherein applying current to the induction heating coil induces heating in the elongate conductive joggle die to a substantially uniform temperature that varies by less than about +/−10 degrees F. (+/−5.6 degrees C.) along a length of the elongate conductive joggle die.

19. The method of paragraph D0, wherein heating the elongate conductive joggle die to at least the first predetermined temperature requires no more than 10 minutes.

20. The method of paragraph D0, wherein applying sufficient current includes applying current for a time that heats the elongate conductive joggle die to at least a second predetermined temperature higher than the first predetermined temperature.

Advantages, Features, Benefits

The different embodiments of the methods and systems for the induction heating of dies described herein provide several advantages over previous approaches for achieving and/or maintaining a uniform temperature for a pressing die. Through the use of induction heating, the pressing die can be rapidly and efficiently heated in a fraction of the time that would have been required for a conventional oven. In addition, by employing the EM field stabilizers of the present disclosure in conjunction with the induction heating, the pressing die can be heated substantially uniformly, permitting the workpiece in turn to be heated uniformly by the pressing die, and therefore alleviating and/or preventing complications in the workpiece due to thermal stresses. Thus, the illustrative embodiments described herein are particularly useful for metal working using heated pressing dies. However, not all embodiments described herein provide the same advantages or the same degree of advantage.

CONCLUSION

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure.

We claim:

1. A system for heating an elongate forming die, the forming die having opposing ends defining a long axis, the system comprising:

an induction coil configured to surround the forming die and heat the forming die by generating an electromagnetic field within the forming die; and a pair of electromagnetic (EM) field stabilizers, each configured to be disposed entirely within the induction coil along the long axis of the forming die and adjacent to one of the opposing ends of the forming die while the forming die is within the induction coil, wherein each EM field stabilizer includes a plurality of stabilizer plates, wherein:

each of the stabilizer plates define a plane;

the plurality of stabilizer plates are each separated by a non-metallic spacer material;

each of the stabilizer plates include a magnetic material; and each of the pair of EM field stabilizers is configured so that the planes of the stabilizer plates are at least substantially parallel to a long axis of the induction coil when adjacent an end of the forming die;

such that the pair of EM field stabilizers is configured to create a substantially uniform magnetic field within the forming die as the forming die is heated by the induction coil.

2. The system of claim 1, wherein the non-metallic spacer material comprises at least one of air, foam, wood, and paper.

3. The system of claim 1, wherein each stabilizer plate comprises a ferrite sheet.

4. The system of claim 1, wherein the plurality of stabilizer plates of each EM field stabilizer is arranged in a parallel and equidistantly-spaced configuration.

5. The system of claim 4, wherein each EM field stabilizer comprises from 4 to 20 stabilizer plates.

6. The system of claim 1, wherein each EM field stabilizer is disposed within 1/16 inch (1.6 mm) of a respective end of the forming die.

7. A method of induction heating, the method comprising:

placing an elongate conductor within an induction coil, the elongate conductor having opposing ends defining a long axis of the elongate conductor;

placing a pair of electromagnetic (EM) field stabilizers, each configured to be disposed entirely within the induction coil along the long axis of the elongate conductor and adjacent to one of the opposing ends of the elongate conductor while the elongate conductor is within the induction coil, wherein each EM field stabilizer includes a plurality of stabilizer plates, wherein:

each of the stabilizer plates define a plane;

the plurality of stabilizer plates are each separated by a non-metallic spacer material;

each of the stabilizer plates include a magnetic material; and each of the pair of EM field stabilizers is configured so that the planes of the stabilizer plates are at least substantially parallel to a long axis of the induction coil when adjacent an end of the elongate conductor; and applying current to the induction coil to heat the elongate conductor; wherein the EM field stabilizers create a substantially uniform magnetic field within the elongate conductor as the elongate conductor is heated by the induction coil.

8. The method of claim 7, wherein placing the elongate conductor within the induction coil comprises placing a forming die that is the elongate conductor within the induction coil.

9. The method of claim 7, wherein the non-metallic spacer material comprises at least one of air, foam, wood, and paper.

10. The method of claim 7, wherein each stabilizer plate comprises a ferrite sheet.

11. The method of claim 7, wherein the plurality of stabilizer plates of each EM field stabilizer is arranged in a parallel and equidistantly-spaced configuration.

12. The method of claim 7, wherein each EM field stabilizer comprises from 4 to 20 stabilizer plates.

13. The method of claim 7, wherein each EM field stabilizer is disposed within 1/16 inch (1.6 mm) of a respective end of the elongate conductor.

14. The method of claim 7, wherein applying current to the induction coil induces heating in the elongate conductor to a substantially uniform temperature that varies by less than about +/−10 degrees F. (or +/−5.6 degrees C.) along a length of the elongate conductor.

15. A method of forming a joggle bend in a structure, the method comprising:

placing an elongate conductive joggle die within an induction coil;

placing a pair of electromagnetic (EM) field stabilizers, each configured to be disposed entirely within the induction coil along a long axis of the elongate conductive joggle die and adjacent to one of the opposing ends of the elongate conductive joggle die while the elongate conductive joggle die is within the induction coil, wherein each EM field stabilizer includes a plurality of stabilizer plates, and wherein:

each of the stabilizer plates define a plane;

the plurality of stabilizer plates are each separated by a non-metallic spacer material;

each of the stabilizer plates include a magnetic material; and each of the pair of EM field stabilizers is configured so that the planes of the stabilizer plates are at least substantially parallel to a long axis of the induction coil when adjacent an end of the elongate conductive joggle die;

applying current to the induction coil so as to induce substantially uniform heating in the elongate conductive joggle die for a time sufficient to heat the elongate conductive joggle die to at least a first predetermined temperature;

placing the heated elongate conductive joggle die in a joggle press;

placing the structure in the heated elongate conductive joggle die; and forming the joggle bend in the structure by compressing the heated elongate conductive joggle die in the joggle press.

16. The method of claim 15, wherein applying current to the induction coil induces heating in the elongate conductive joggle die to a substantially uniform temperature that varies by less than about +/−10 degrees F. (or +/−5.6 degrees C.) along a length of the elongate conductive joggle die.

17. The method of claim 15, wherein heating the elongate conductive joggle die to at least the first predetermined temperature requires no more than 10 minutes.

18. The method of claim 15, wherein applying current includes applying the current for a time that heats the elongate conductive joggle die to at least a second predetermined temperature higher than the first predetermined temperature.

19. The method of claim 15, wherein each stabilizer plate comprises a ferrite sheet.

20. The method of claim 15, wherein the plurality of stabilizer plates of each EM field stabilizer is arranged in a parallel and equidistantly-spaced configuration.

* * * * *